US005476086A

United States Patent [19]

Smith

[11] Patent Number: 5,476,086

[45] Date of Patent: Dec. 19, 1995

[54] MICRO ADJUST ARROW REST

[76] Inventor: Jimmie T. Smith, P.O. Box 667, Bixby, Okla. 74008

[21] Appl. No.: 180,862

[22] Filed: Jan. 12, 1994

[51] Int. Cl.[6] ..... F41B 5/22

[52] U.S. Cl. ..... 124/44.5; 124/24.1

[58] Field of Search ..... 124/44.5, 41.1, 124/24.1

[56] References Cited

U.S. PATENT DOCUMENTS

| | | | |
|---|---|---|---|
| 3,292,607 | 12/1966 | Hoyt, Jr. . | |
| 4,592,332 | 6/1986 | Topping | 124/41.1 |
| 4,686,956 | 8/1987 | Troncoso, Jr. | 124/41.1 |
| 4,838,237 | 6/1989 | Cliburn | 124/41.1 |
| 4,867,129 | 9/1989 | Scherz | 124/41.1 |
| 5,062,407 | 11/1991 | Newbold | 124/44.5 |
| 5,070,855 | 12/1991 | Troncoso | 124/44.5 |
| 5,081,980 | 1/1992 | Newbold | 124/44.5 |
| 5,095,884 | 3/1992 | Mertens | 124/44.5 |
| 5,103,797 | 4/1992 | Newbold | 124/44.5 |
| 5,117,803 | 6/1992 | Johnson | 124/44.5 |
| 5,285,764 | 2/1994 | Mertens | 124/44.5 |

*Primary Examiner*—Anthony Knight
*Attorney, Agent, or Firm*—Scott R. Zingerman; Frank J. Catalano

[57] ABSTRACT

A micro adjust arrow rest including a mounting bracket and a body having a face plate and a U-shaped carriage. Each end of a shaft is supported by the U-shaped carriage. One end of the shaft extends beyond the carriage and receives a collar. A torsion spring is secured inside the carriage adjacent the collar. A launcher body is supported by the shaft within the U-shaped carriage. A pair of launcher fingers are fixed into the launcher body. The torsion spring secured to the carriage and the collar allows the shaft, launcher body, and launcher fingers to bias. Coarse lateral adjustment is provided by a mounting block, mounting bracket, and threaded pin. The threaded pin clamps a female dovetail of the mounting bracket onto a male dovetail of the mounting block. The mounting bracket secures the archery rest to an archery bow and includes a semi-elliptical portion which receives a bolt secured to the bow. The bolt can be tightened anyplace in the semi-elliptical portion for horizontal adjustability. The micro adjustment feature includes the shaft which contains a cavity and has a window cut in its side. A screw is inserted into the cavity of the shaft so that the threads of the screw are exposed through the window. A screw follower is secured into the launcher body and threadedly engages the screw through the window. Rotation of the screw within the shaft moves the launcher body laterally along the shaft.

13 Claims, 4 Drawing Sheets

MICRO ADJUST ARROW REST

BACKGROUND OF THE INVENTION

FIELD OF THE INVENTION

This invention relates to the archery industry and more specifically to arrow rests capable of lateral adjustment.

Since an arrow is being pushed from the bow by the bow string, they have been known to bend and twist as they leave the bow and proceed toward the target. The bending and twisting of the arrow affects the accuracy and consistency of the bow (and thereby the archer).

As bow technology has progressed, bows have become capable of releasing an arrow at much greater velocity than was previously known. This increase in arrow velocity has compounded the bending and twisting problem of the arrow.

Arrow rests help reduce this problem by delivering an arrow that has little movement and absorbing some of the force that causes the arrow to bend and twist. Arrow rests that are under spring resistance and deflect downward upon release of the arrow aid in this effort. An arrow rest, however, must also be capable of adjustability so as to accurately deliver an arrow to the target. An arrow rest must be capable of left-to-right, or lateral, movement.

A need has therefore arisen for an arrow rest that is capable of precise lateral adjustment and then locked into place. A need has also arisen for such a precisely adjustable rest that is under spring resistance so as to deflect downwardly (bias) upon the release of an arrow. A yet further need is for an arrow rest where the components capable of micro adjustment also bias in order to produce a compact, efficient device.

SUMMARY OF THE INVENTION

The present invention provides a micro adjust arrow rest for use in archery generally including a mounting bracket and a body having a face plate and a U-shaped carriage. The carriage has a circular channel drilled therein to receive a shaft. Each end of the shaft is supported in the carriage by a bushing. One end of the shaft extends beyond the carriage and receives a collar. A torsion spring is secured inside the carriage adjacent the collar-where one end of the torsion spring is secured to the carriage, and its other end is secured to the collar.

A launcher body is supported by the shaft within the U-shaped carriage. A pair of launcher fingers are fixed into the launcher body.

The torsion spring secured to the carriage and the collar provides means to bias the shaft, the launcher body supported by the shaft, and thereby the launcher fingers such that when the arrow is released from the bow, the launcher body will deflect downward to absorb some of the force that may cause the arrow to bend and twist.

A coarse lateral adjustment means provides lateral adjustability to the arrow rest. Coarse lateral adjustment means includes a mounting block, mounting bracket, and a threaded pin. The mounting block includes a male dovetail and is fixed to the face plate of the body essentially making it and the face plate a solid piece of material.

The mounting bracket is elliptical in shape with the exception of having a female dovetail on one end. The ellipse formed by the mounting bracket is not closed at the female dovetail, leaving a gap. A bore is drilled through the vertical axis of the mounting bracket to receive a threaded pin. The threaded pin includes a knurled knob for rotation by the fingers of the archer's hand. Tightening the threaded pin forces the two sections of the mounting bracket together, thereby clamping the female dovetail onto the male dovetail of the mounting block.

The mounting bracket also secures the arrow rest to an archery bow. The mounting bracket receives a mounting bolt for insertion into a threaded bore contained in the side of the bow. The threaded bolt is screwed into the threaded bore on the bow to secure the mounting bracket on the bow.

The combination of the female dovetail and the male dovetail provide coarse lateral adjustment of the body in relation to the mounting bracket. When the mounting bracket is secured to the archery bow, the threaded pin is loosened so as to relieve the clamping pressure placed on the female and male dovetails. The body is then moved from side to side as desired and threaded pin again tightened to clamp the female dovetail onto the male dovetail.

The micro adjustment feature includes the shaft which contains a cavity and has an oval window cut in its side into the cavity. A threaded micro adjust screw is inserted into the cavity of the shaft so that a portion of the threads of the micro adjust screw are exposed through the window. The threaded micro adjust screw is held inside the shaft by a sleeve plug press fit inside the shaft.

The launcher body contains an elliptical threaded hole such that when the launcher body is mounted on the shaft, the window of the shaft is aligned under the elliptical threaded hole in the launcher body. A substantially rectangular screw follower is inserted into the elliptical hole in the launcher body. One face of the screw follower is threaded to mate the threads of the micro adjust screw. A threaded set screw is then screwed inside the elliptical hole in the launcher body after the screw follower is installed. The set screw applies pressure on the screw follower against the threaded micro adjust screw.

When the micro adjustment screw is installed in the shaft, both ends are flush with the ends of the shaft. The end of the micro adjust screw that is inside the end of the shaft that extends past the carriage, onto which the collar is secured, receives an allen wrench so that the micro adjust screw may be rotated within the shaft. Rotation of the micro adjust screw within the shaft moves the launcher body from right to left along the shaft, depending upon the rotation of the micro adjust screw. Launcher body moves in relation to rotation of the micro adjust screw since the screw follower is secured within the launcher body and is in threaded engagement with the micro adjust screw.

Once an archer obtains optimal setting of the micro adjustment apparatus two locking screws, which are secured in bores in the launcher body and extend into the U-shaped groove machined into the shaft, lock the launcher body into the desired position on the shaft. This U-shaped groove is located at a position 180° from the window in the shaft. This allows the archer to shoot several "test" arrows before locking down the micro adjust system.

There has thus been outlined, rather broadly, the more important features of the invention in order that the detailed description thereof that follows may be better understood. There are, of course, additional features of the invention that will be described hereinafter and which will form the subject matter of the claims appended hereto. It is therefore an object of this invention to describe an arrow rest apparatus which provides coarse and fine lateral adjustment of the launcher body on the shaft to provide a precise lateral adjustment.

A further object of this invention is to describe an arrow rest capable of precise micro adjustment which will also bias upon release of the arrow. A still further object is to provide an arrow rest where the launcher body is capable of precise lateral movement on the shaft and where the shaft and the launcher body will bias. Other objects can be seen from the following description.

DETAILED DESCRIPTION OF THE PREFERRED EMBODIMENT

Attention is next directed to the drawings which show the arrow rest of this invention.

Figure 1:
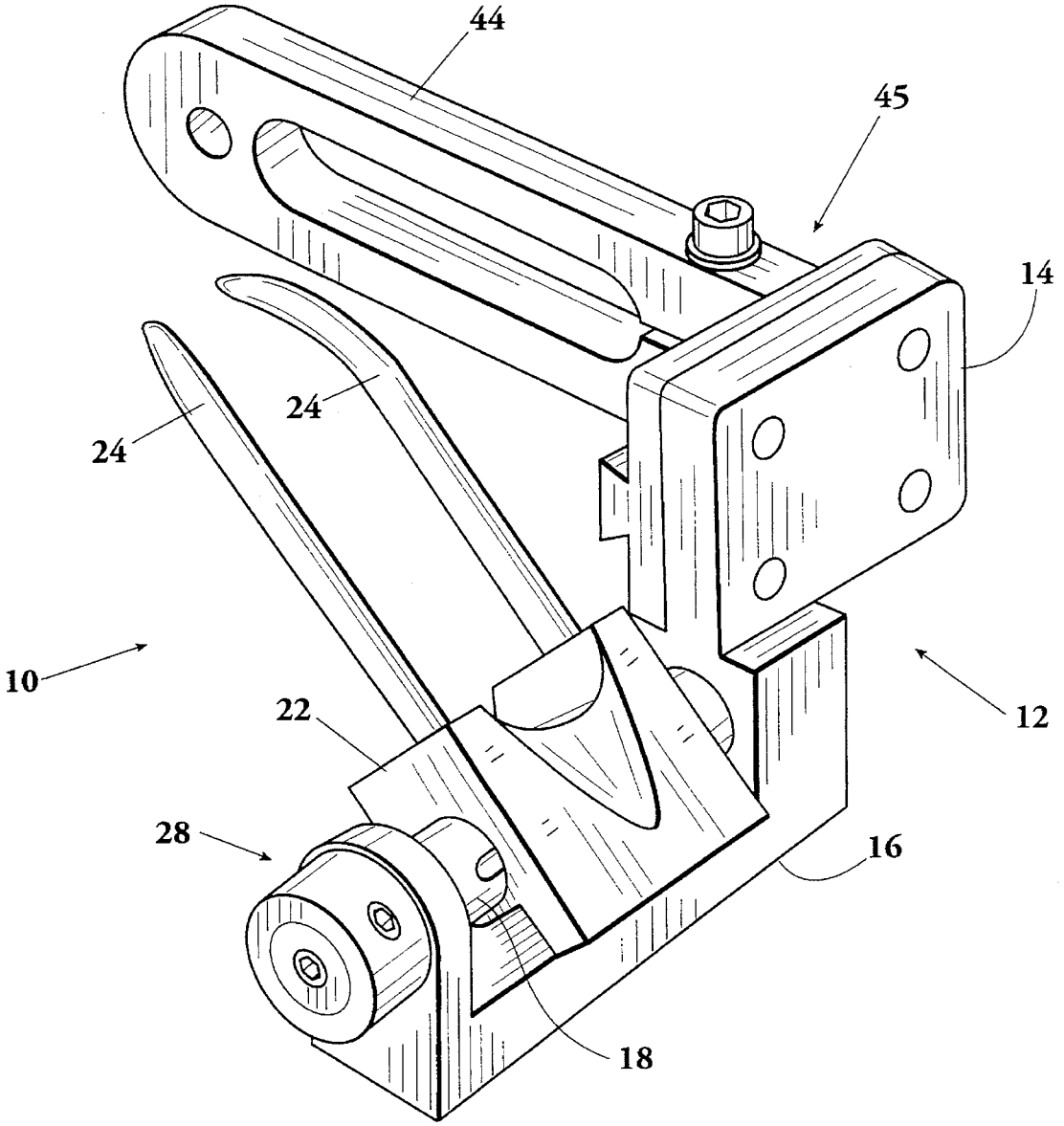
FIG. 1 is an isometric view of the arrow rest of the present invention.

FIG. 1 illustrates the arrow rest 10 of the present invention, including a mounting bracket 44 and a body 12. Mounting bracket 44 secures arrow rest 10 to an archery bow. Body 12 includes a face plate 14 and a U-shaped carriage 16. A shaft 18 is supported by carriage 16 and carries a launcher body 22. A pair of launcher fingers 24 are fixed in launcher body 22. Carriage 16 also supports a biasing means 28 which allows shaft 18 and launcher body 22 to bias upon release of an arrow supported by launcher fingers 24.

Arrow rest 10 also includes a coarse lateral adjustment means 45 and a micro adjustment means contained within shaft 18. Coarse and fine lateral adjustment means provide precise lateral adjustments.

Figure 2:
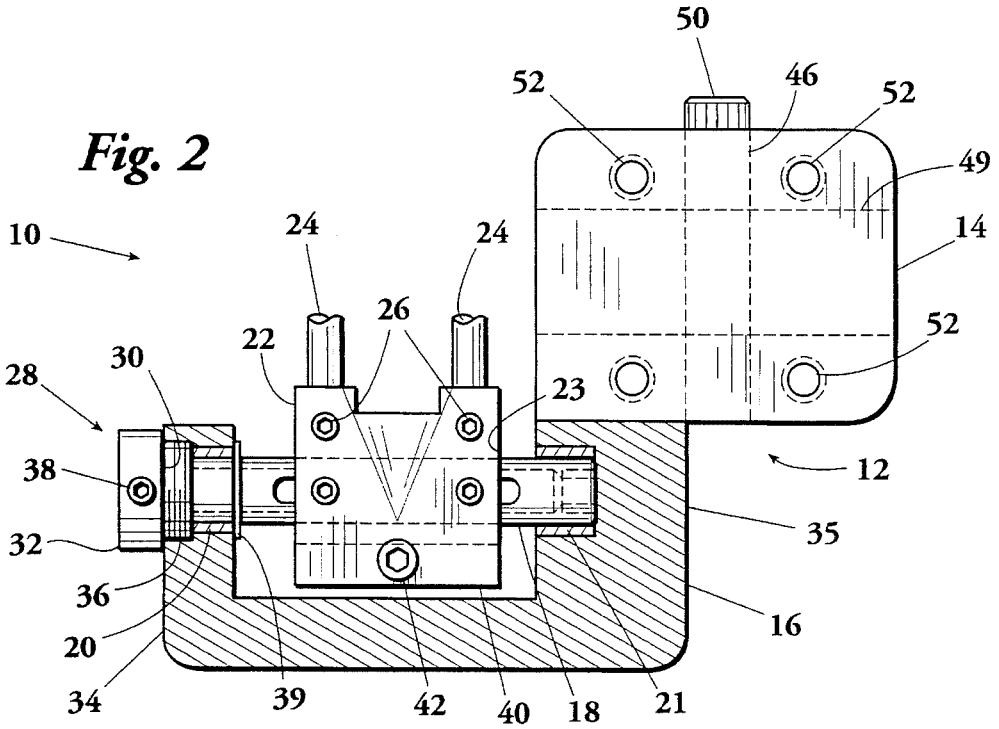
FIG. 2 is a front view of the arrow rest of the present invention.

FIG. 2 is a front view of the arrow rest 10 of the present invention. Arrow rest 10 includes a unitary body 12 having a face plate 14 and a U-shaped carriage 16. Carriage 16 has a channel cut therein to receive a shaft 18. Shaft 18 is secured within carriage 16 by a pair of bushings 20 and 21 located on each end of shaft 18. Bushings 20 and 21 secured in carriage 16 provide stability to both ends of shaft 18.

A launcher body 22 having a circular channel 23(in phantom) cut therein is mounted on shaft 18. Shaft 18 extends through channel 23 in launcher body 22 such that when shaft 18 is secured within carriage 16 by bushings 20 and 21, launcher body 22 is retained on shaft 18 within the U-shaped portion of carriage 16. Left bushing 20 is shorter than right bushing 21. At least one launcher finger 24 can be mounted onto launcher body 22 so that an archery arrow will "rest" upon the terminal ends of launcher finger 24. An alternate embodiment would replace one launcher finger with a plunger (not shown) fixed to mounting bracket 44 (of FIG. 3). An arrow would then rest upon remaining launcher finger 24 and the plunger. This launcher finger/plunger arrangement is not a part of the present invention. It is mentioned because it is common in the art and can be easily adapted and installed on the arrow rest apparatus of the present invention without departing from the spirit and scope.

Launcher fingers 24 are secured to launcher body 22 by set screws 26. Threaded bores are drilled in launcher body 22 so receive set screws 26. Set screws 26 apply pressure upon launcher fingers 24 to retain them within launcher body 22. Adjustment of the length of each launcher finger 24 may be accomplished independently using set screws 26. Since both launcher fingers 24 are retained within launcher body 22, launcher fingers 24 will have an equal and even rotation as they rotate out of position as the arrow departs from arrow rest 10, providing a more accurate delivery of the arrow to its intended target.

Arrow rest 10 includes a biasing means 28 having a torsion spring 30 and collar 32. Torsion spring 30 is mounted on carriage 16 of arrow rest 10 in order to apply bias to shaft 18. Torsion spring 30 is contained within collar 32. Torsion spring 30 and collar 32 are mounted over and around shaft 18.

Looking at FIG. 2, one end of shaft 18 extends beyond the left sidewalls 34 of carriage 16, leaving sufficient space for collar 32. A channel cut in left sidewall 34 for shaft 18 includes a portion of increased internal diameter 36 in order to receive torsion spring 30. One end of torsion spring 30 is connected to carriage 16 at the portion of increased internal diameter 36 of the channel cut in left side wall 34. The other end of torsion spring 30 is connected to collar 32. A small bore 38 (shown in FIG. 3) is drilled in collar 32 to receive one end of torsion spring 30. A threaded bore is drilled through collar 32 and into shaft 18 to receive a set screw 38. Set screw 38 secures collar 32 to shaft 18. Bias is thereby provided when a force is exerted on launching fingers 24 through launcher body 22 to rotate shaft 18, compressing torsion spring 30. Relieving the force on launcher fingers 24 allows torsion spring 30 to release tension, thereby rotating shaft 18, launcher body 22, and launcher fingers 24 to their original position. A rest position is provided by launcher body 22 which contains a tab 40 which contacts carriage 16. Tab 40 extends the width of launcher body 22 and contacts carriage 16 so as to prevent torsion spring 30 from rotating launcher body 22 approximately 180° so that launcher fingers 24 rest upon carriage 16.

Upon assembly, bushings 20 are inserted into the circular channel drilled through left sidewall 34 and right sidewall 35 of carriage 16. Shaft 18 is then inserted into the channel 23 drilled in left sidewall 34 through the left bushing 20, the circular hole drilled in launcher body 22 (shown in phantom in FIG. 2) and into the circular channel drilled partially through right sidewall 35 of carriage 16. Shaft 18 is inserted into right bushing 21 press fit into right sidewall 35. Once shaft 18 is secured within carriage 16, torsion spring 30 of biasing means 28 is fixed within the enlarged portion 36 of the channel drilled in left sidewall 34 such that one end of torsion spring 30 is secured into carriage 16. Collar 32 is then slipped over the end of shaft 18 which extends past left sidewall 34 of carriage 16. The other end of torsion spring 30 is inserted into the bore 37 (as shown in FIG. 3) in collar 32.

Figure 4:
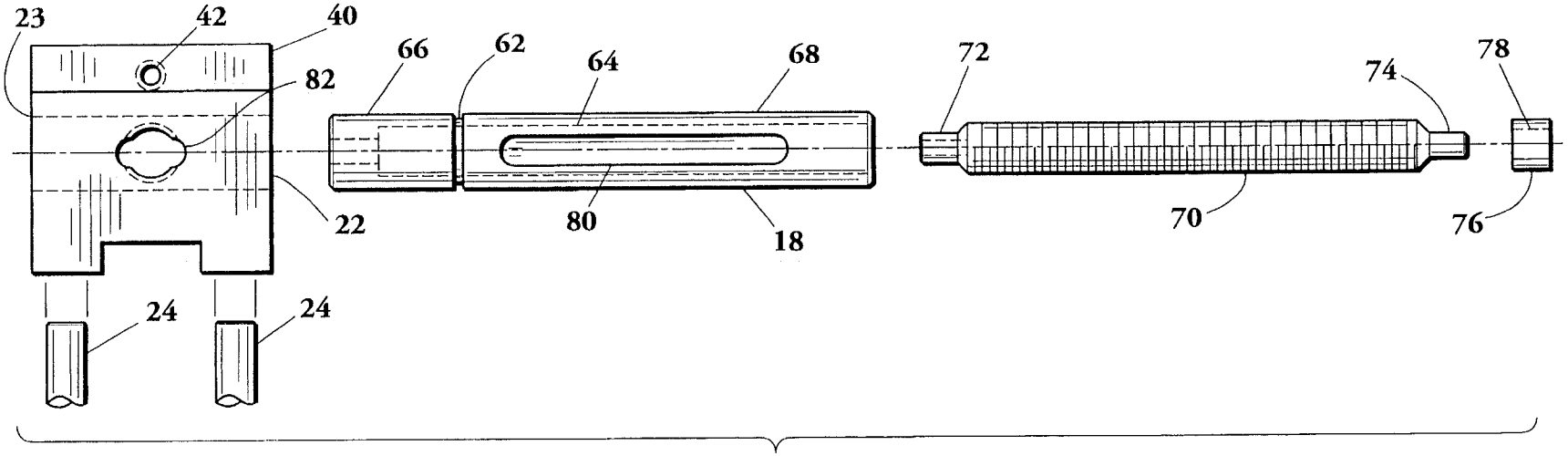
FIG. 4 is an exploded view of the micro adjust apparatus.

A spring washer 39 retains shaft 18 and biasing means 28 retained within carriage 16. A spring washer channel 62 (as seen in FIG. 4) is cut in shaft 18 to receive spring washer 39.

Set screw 38 is then screwed into the threaded bore drilled through collar 32 into shaft 18.

Figure 3:
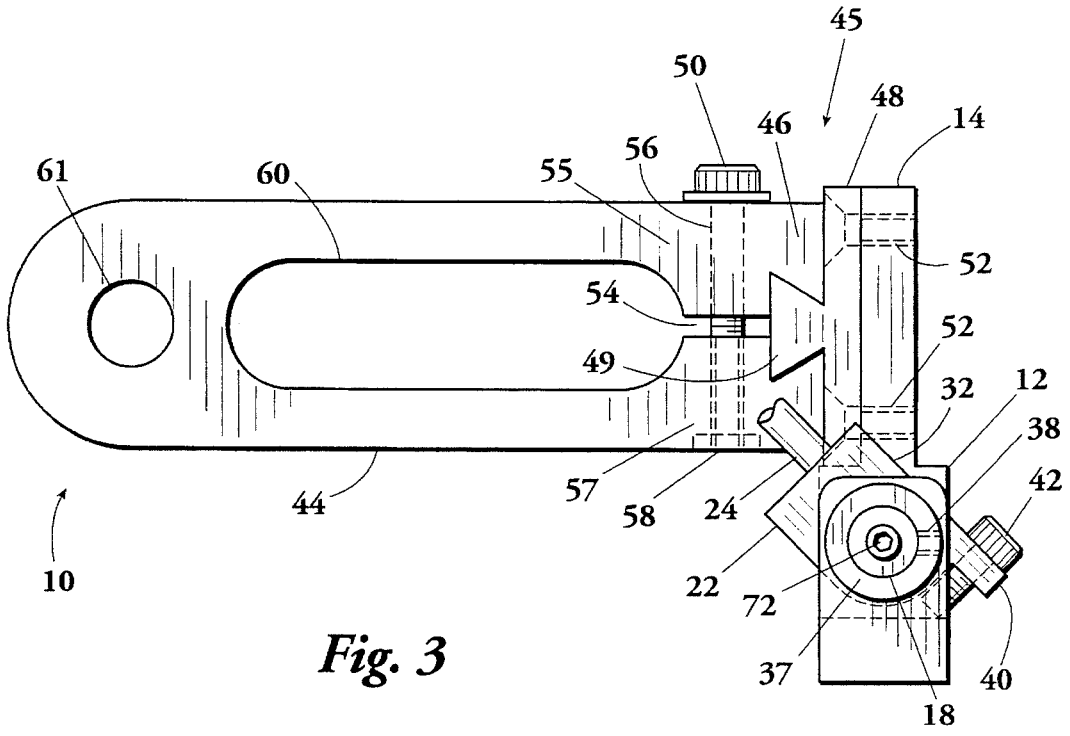
FIG. 3 is a side view of the arrow rest of the present invention.

As can be seen in FIG. 3, tab 40 extends beyond launcher body 22. Referring to FIG. 3, a threaded bore is drilled through launcher body 22 on tab 40 to receive a height adjustment screw 42. Height adjustment screw 42 is screwed into this threaded bore through tab 40 and extending beyond launcher body 22 towards carriage 16. Tab 40 and height adjustment screw 42 function as a stop to limit the rotation of shaft 18 and launcher body 22 fixed on shaft 18. As shaft 18 rotates, tab 40 and height adjustment screw 42 also rotate. Tab 40 and height adjustment screw 42 thereby limit the rotation of shaft 18 at a Specific position. The specific position being adjustable by the positioning of height adjustment screw 42 in tab 40. When height adjustment screw 42 is positioned so that it extends into, but not through tab 40, tab 40 rests on carriage 16. At this rotation, launcher body 22 and launcher fingers 24 are at their maximum height adjustment for an arrow resting on launcher fingers 24. When height adjustment screw 42 is screwed through tab 40, it rests upon carriage 16, thereby limiting the rotation of shaft 18. Height adjustment screw 42 thereby prevents shaft 18 from a full rotation where tab 40 rests upon carriage 16. Height adjustment screw 42 is shown in FIG. 3 to contact carriage 16, preventing tab 40 from resting on carriage 16, leaving a space between tab 40 and carriage 16.

When height adjustment screw 42 is screwed fully into tab 40, the space between tab 40 and carriage 16 will be at a maximum. At this position, launcher body 22, launcher fingers 24, and an arrow resting on launcher fingers 24 are at their minimum height adjustment.

Height adjustment is provided to ensure that the arrow has a level trajectory upon release. The height of an arrow resting on launcher fingers 24 should be level with its nock point on the bow string. A coarse lateral adjustment means 45 provides lateral adjustability to arrow rest 10. Coarse lateral adjustment means 45 includes a mounting block 48, mounting bracket 44, and threaded pin 50. Mounting block 45 includes a male dovetail and is fixed to face plate 14 of body 12 using four (4) flathead screws, collectively 52, essentially making mounting block 48 and face plate 14 a solid piece of material. Mounting bracket 44 is elliptical in shape with the exception of having a female dovetail 46 on one end. Female dovetail 46 receives male dovetail 49 of mounting block 48.

The ellipse formed by mounting bracket 44 is not closed at female dovetail 46, leaving a gap 54. A bore 55 is drilled through the vertical axis of mounting bracket 44, upper clamp 58, gap 54, and lower clamp 57. The lower segment of bore 55 drilled through lower clamp 57 of mounting bracket 44 is of a larger internal diameter to receive a circular threaded insert 58. Circular threaded insert 58 is press fit into bore 56 in lower clamp 57. A threaded pin 50 is inserted into bore 56 and screwed into circular threaded insert 58. Threaded pin 50 includes a knurled knob for rotation of threaded pin 50 by the fingers of the archer's hand. Tightening threaded pin 50 into circular threaded insert 58 forces lower clamp 57 and upper clamp 59 together. This action clamps female dovetail 46 onto male dovetail 49.

Mounting bracket 44 secures arrow rest 10 to an archery bow. The elliptical portion 60 of mounting bracket 44 receives a mounting bolt for attaching mounting bracket 44 to a bow. Upon installation, mounting bracket 44 is positioned such that elliptical portion 60 is over a threaded bore contained in the side of the bow. A washer is placed over a mounting bolt, and the mounting bolt is placed through elliptical portions 60 and screwed into the threaded bore on the bow. The mounting bolt is tightened to secure mounting bracket 44 to the archery bow.

Elliptical portion 60 provides for the horizontal adjustment of mounting bracket 44 and thereby archery rest 10 on the bow. The mounting bolt could be tightened at any point within elliptical portion 60 in order to move arrow rest 10 forward or back in relation to the mounting bolt secured into the bow.

Bore 61 receives a set screw secured to the bow in order to tighten mounting bracket 44 against the bow. This provides additional stability to the arrow rest 10 on the bow by preventing mounting bracket 44 from rotating about the mounting bolt installed in elliptical portion 60.

The combination female dovetail 46 and male dovetail 49 provide coarse lateral adjustment of body 12 in relation to mounting bracket 44. When mounting bracket 44 is secured to an archery bow by a mounting bolt extending through elliptical portion 60 of mounting bracket 44 and tightened into the archery bow, mounting means 45 provides for coarse lateral movement of body 12 in relation to mounting bracket 44.

Referring to FIG. 2, the width of male dovetail 49 is much greater than the width of female dovetail 46. Since female dovetail 46 is an integral part of mounting bracket 44 secured to the archery bow, male dovetail 49 may move from side to side within female dovetail 46 in order to provide coarse lateral adjustment of body 12. This coarse adjustability is obtained by first unscrewing threaded pin 50 from circular threaded insert 58 to relieve the clamping pressure threaded pin 50 places on female dovetail 46 and male dovetail 49. Body 12 is then moved from side to side as desired, and threaded pin 50 again tightened into circular threaded insert 58 to clamp female dovetail 46 onto male dovetail 49.

Lateral adjustability is very important in ensuring that an arrow resting on launcher finger 24 is aligned with the bow to ensure a proper trajectory toward an intended target. If arrow rest 10 is not aligned properly left-to-right, the arrow will miss its intended target.

FIG. 4 shows the micro adjust system of the present invention in an exploded view. The micro adjust system of the present invention complements the coarse lateral adjustment provided by mounting means 45 to precisely provide fine lateral adjustability for an arrow resting on arrow rest 10. FIG. 4 shows launcher body 22 rotated 180° around shaft 18. Launcher body 22 includes shaft channel 23 drilled therein, a partial view of launcher fingers 24, tab 40, and height adjustment screw 42 extending through tab 40.

Shaft 18 is shown with channel 62 cut therein to receive spring washer 39 (of FIG. 2). A cavity 64, shown in phantom, is drilled in shaft 18 to receive a threaded micro adjust screw 70.

The terminal ends 72 and 74 of micro adjust screw 70 are not threaded and are of a reduced external diameter to facilitate securing micro adjust screw 70 into shaft 18. Cavity 64 in shaft 18 is drilled having a reduced internal diameter at a first end 66. When micro adjust screw 70 is inserted into cavity 64 of shaft 18, end 72 of micro adjust screw 70 extends through first end 66. End 72 of micro adjust screw 70 is flush with first end 66 when micro adjust screw 70 is fully inserted inside shaft 18. The segment of reduced internal diameter of cavity 64 retains micro adjust screw 70 within first end 66. Since second end 68 must be the same diameter as micro adjusts screw 70 so that micro adjust screw 70 can be inserted inside shaft 18, a sleeve plug 76, having an external diameter so as to be press fit inside second end 68, is used to retain end 74 of micro adjust screw 70 inside shaft 18. The center 78 of sleeve plug 76 is drilled out so that it may fit over end 74 inside shaft 18.

Figure 5:
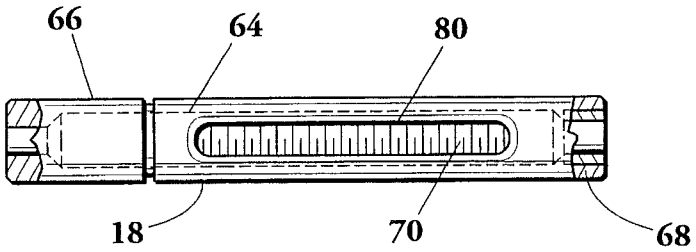
FIG. 5 illustrates the shaft of the arrow rest with the micro adjust screw contained therein.

A window 80 is cut in shaft 18 into cavity 64 thereby revealing a section of threaded micro adjust screw 70 when inserted inside shaft 18. FIG. 5 shows an assembled shaft 18 with first end 66, second end 68, and cavity 64. FIG. 5 also shows window 80 in shaft 18 exposing the threads of micro adjust screw 70.

Referring back to FIG. 4, a semi-elliptical hole 82 is drilled into launcher body 22 into shaft channel 23. When shaft 18 is assembled with micro adjust screw 70 inserted inside and shaft 18 inserted into shaft channel 23, the threads of micro adjust screw 70 can be seen through semi-elliptical hole 82.

Figure 6:
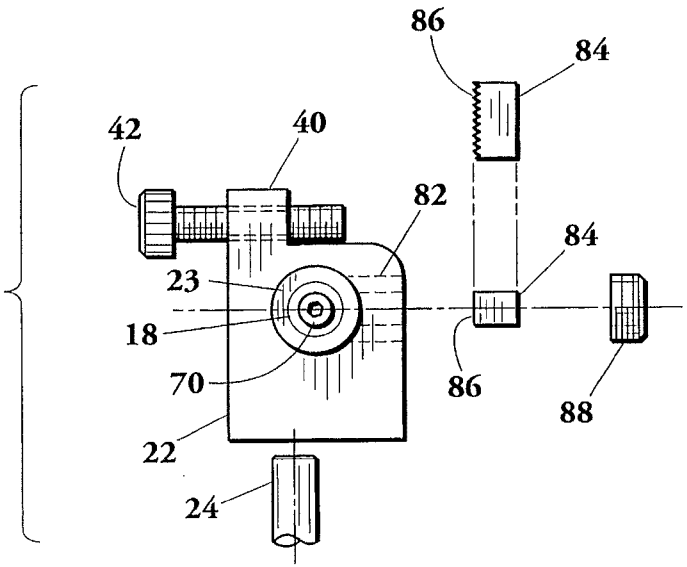
FIG. 6 is a partially exploded side view of the launcher body illustrating the manner in which the screw follower of the micro adjustment feature is installed in the launcher body.

FIG. 6 is a side view of launcher body 22 of FIG. 4 including launcher fingers 24, height adjustment screw 42 extending through tab 40, shaft channel 23, shaft 18, and micro adjust screw 70. Semi-elliptical hole 82 can be seen drilled through launcher body 82 into shaft channel 23.

Semi-elliptical hole 82 is drilled to receive a screw follower 84. Screw follower 84 is substantially rectangular in shape, and one face 86 of screw follower 84 is threaded. The threads of face 86 of screw follower 84 mate the threads of threaded micro adjust screw 70.

Once screw follower 84 is inserted into semi-elliptical hole 82, a threaded set screw 88 is screwed inside semi-elliptical hole 82. Semi-elliptical hole 82 is threaded to mate with the threads of threaded set screw 88.

When installed, set screw 88 applies pressure on screw follower 84 to ensure threaded engagement. Referring to FIGS. 4 and 6, when micro adjust screw 70 is rotated inside shaft 18 using an allen wrench on end 72, screw follower 84 fixed inside launcher body 22, moves body 22 laterally on shaft 18. This feature provides fine adjustment of launcher body 22, and thereby launcher fingers 24, on shaft 18. Course adjustment is provided by moving mounting bracket 44 on mounting block 48 using the combination female dovetail 46 and male dovetail 49.

Referring back to FIG. 3, it can be seen that shaft 18 having end 72 of the micro adjust screw extends through collar 32 so as to receive an allen wrench.

Figure 7:
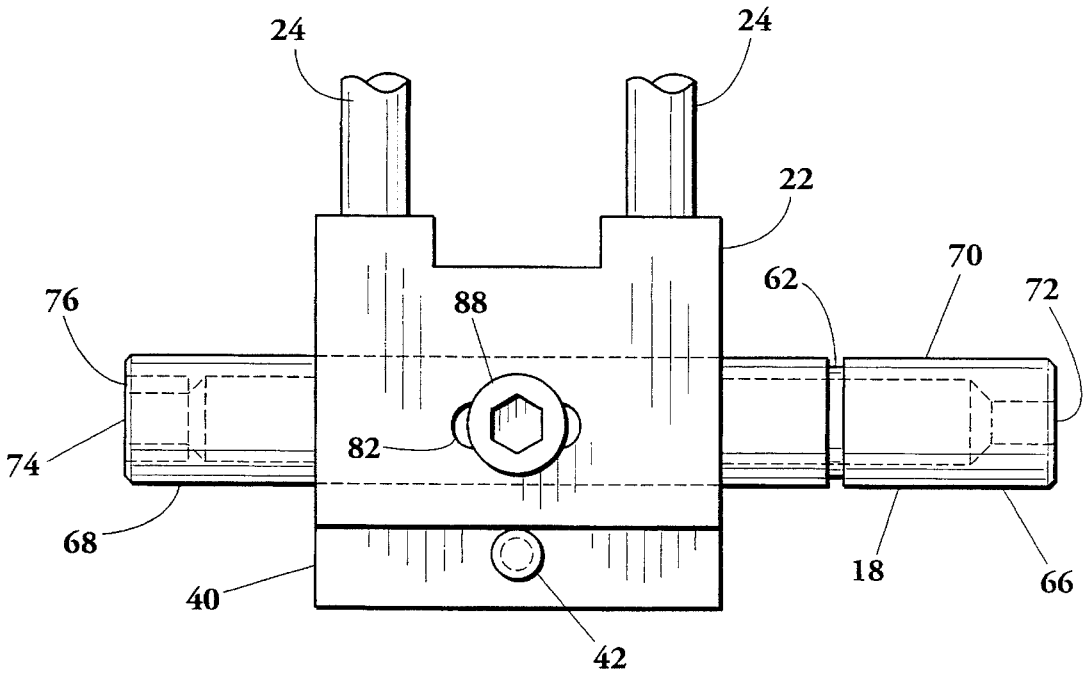
FIG. 7 illustrates the launcher body with the shaft inserted therein.

FIG. 7 shows the micro adjust system of FIG. 4 including launcher body 22 and shaft 18 extending through launcher body 22. Shaft 18 further includes spring washer channel 62, and micro adjust screw 70. Micro adjust screw 70 is inserted such that end 72 is retained by shaft 18 in its first end 66 and second end 74 retained by sleeve plug 76 in second end 68 of shaft 18. Launcher body 22 includes launcher fingers 24, height adjustment screw 42 extending through tab 40, semi-elliptical hole 82, and threaded set screw 88 retaining screw follower 84 (not shown) within semi-elliptical hole 82.

Figure 8:
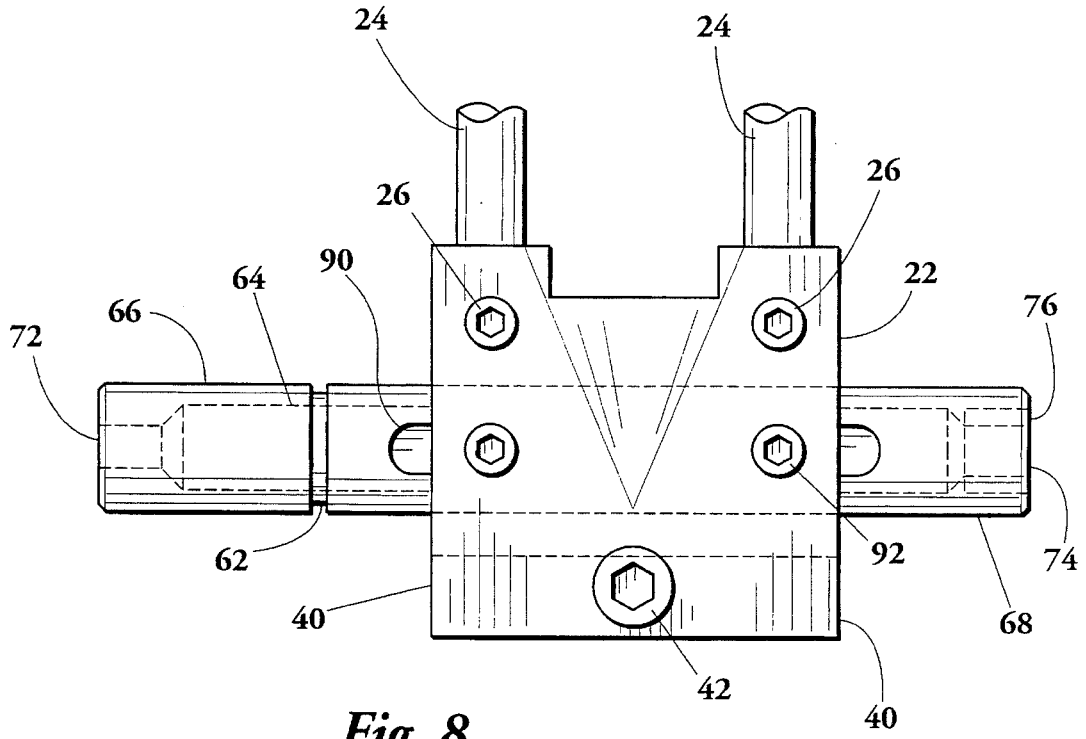
FIG. 8 is a view of the launcher body and the shaft of the present invention rotated 180° from FIG. 7.

FIG. 8 is a view of the micro adjust system of the present invention rotated 180° from FIG. 7. A U-shaped groove 90 is machined in ! shaft 18 at a point 180° on shaft 18 from window 80 (shown in FIG. 5). U-shape groove is machined only partially through shaft 18 and does not extend into cavity 64. A pair of locking screws 92 are screwed through threaded bores drilled through launcher body 22 into U-shaped groove 90. Once an archer obtains optimal setting of the micro adjustment feature, locking screws 90 are tightened so as to lock launcher body 22 onto shaft 18 at the desired position on shaft 18. This additional feature allows the archer to shoot several "test" arrows before locking down the micro adjust system.

In an alternate embodiment, a basic one, the course lateral adjustment system including the male and female dovetails could be eliminated and body 12 rigidly fixed to mounting bracket 44. Such an embodiment would also eliminate the necessity of pin 50. Lateral adjustability would be provided to this basic embodiment by the micro adjust system.

While the invention has been described with a certain degree of particularity, it is manifest that many changes may be made in the details of construction without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. An archery arrow rest, comprising:

a mounting bracket for securing said arrow rest to an archery bow;

means for providing horizontal adjustment of said arrow rest;

a body including a substantially U-shaped carriage;

means for fixing said body to said mounting bracket;

said substantially U-shaped carriage having a shaft channel drilled therein;

a shaft supported on each end by a pair of bushings secured in said substantially U-shaped carriage;

a launcher body supported by said shaft;

means for providing coarse lateral adjustment of said arrow rest;

means for providing fine lateral adjustment of said arrow rest;

at least one launcher finger fixed to said launcher body to support an arrow;

means for biasing said shaft and said launcher body within said carriage.

2. The arrow rest of claim 1 wherein said means for providing horizontal adjustment includes a semi-elliptical portion on said mounting bracket to receive a mounting bolt to be screwed into a threaded bore in said archery bow such that said mounting bolt may be tightened at any position within said semi-elliptical portion.

3. The arrow rest of claim 1 wherein said means for fixing said body to said mounting bracket includes:

a female dovetail on said mounting bracket wherein said semi-elliptical portion is not closed forming an upper clamp and a lower clamp with a gap between;

a male dovetail fixed to said body and secured on said female dovetail;

a threaded pin inserted into a bore drilled through said upper clamp, said lower clamp, and said gap between;

said threaded pin having a knurled knob;

a circular threaded insert press fit in said lower clamp with threads mating the threads of said threaded pin such that tightening said threaded pin into said circular threaded insert clamps said upper clamp and said lower clamp of said female dovetail onto said male dovetail.

4. The arrow rest of claim 3 wherein said means for providing coarse lateral adjustment includes the combination female dovetail and male dovetail with the male dovetail being of a substantially greater width than said female dovetail in order that said female dovetail may be clamped at the desired lateral position along said male dovetail.

5. The arrow rest of claim 1 wherein said means for providing fine lateral adjustment includes:

said shaft having a cavity drilled therein and a window machined on its horizontal axis;

a threaded micro adjust screw inserted inside said cavity in said shaft such that the threads of said micro adjust screw are exposed through said window in said shaft;

said launcher body halving a threaded semi-elliptical bore drilled therein to receive a screw follower with one face having threads mating the threads of said micro adjust screw;

said semi-elliptical bore of said launcher body secured on said shaft over said window where said threads of said micro adjust screw are exposed;

a set screw threaded into said semi-elliptical bore after said screw follower is inserted to force said screw follower into threaded engagement with said micro adjust screw through said window in said shaft such that rotation of said micro adjust screw moves said screw follower and thereby said launcher body laterally along said shaft.

6. The arrow rest of claim 1 wherein said means for biasing said shaft and said launcher body within said carriage includes:

said shaft having a first end and a second end;

said U-shaped carriage having a first wall and a second wall;

said first end of said shaft extending through said first wall of said U-shaped carriage;

a collar fixed to said first end of said shaft adjacent said U-shaped carriage;

said shaft channel having an enlarged segment in said first wall of said U-shaped carriage;

a torsion spring having a first end and a second end secured in said enlarged segment wherein one end of said torsion spring is secured in said first wall of said U-shaped carriage and said second end secured to said collar;

said torsion spring thereby providing bias to said shaft and said launcher body.

7. The arrow rest of claim 3 wherein said means for providing coarse lateral adjustment of said arrow rest includes said male dovetail being of a greater width than said female dovetail such that loosening said threaded pin in said threaded insert allows said male dovetail to slide laterally in said female dovetail along the width of said male dovetail.

8. An archery arrow rest, comprising:

means for securing said arrow rest to an archery bow;

a body including a substantially U-shaped carriage;

means for fixing said body to said means for securing said arrow rest to an archery bow;

a shaft supported on each end by said substantially U-shaped carriage;

said shaft having a cavity along its longitudinal axis and a window machined at least partially on its longitudinal axis;

a threaded micro adjust screw inserted inside said cavity in said shaft such that the threads of said micro adjust screw are exposed through said window in said shaft;

said launcher body having a threaded bore drilled therein to receive a screw follower with one face having threads mating the threads of said micro adjust screw;

said bore of said launcher body secured on said shaft over said window where said threads of said micro adjust screw are exposed;

means for securing said screw follower in said threaded bore;

a launcher body supported by said shaft;

means fixed to said launcher body for supporting an arrow;

means for biasing said shaft and said launcher body within said carriage.

9. The arrow rest of claim 8 wherein said means for securing said arrow rest to an archery bow includes a mounting bracket having a semi-elliptical portion to receive a mounting bolt to be screwed into a threaded bore in said archery bow such that said mounting bolt may be tightened at any position within said semi-elliptical portion.

10. The arrow rest of claim 9 wherein said means for fixing said body to said means for securing said arrow rest to an archery bow includes:

a female dovetail on said mounting bracket wherein said semi-elliptical portion is not closed forming an upper clamp and a lower clamp with a gap between;

a male dovetail fixed to said body and secured on said female dovetail;

a threaded pin inserted into a bore drilled through said upper clamp, said lower clamp, and said gap between;

said threaded pin having a knurled knob;

a circular threaded insert press fit in said lower clamp with threads mating the threads of said threaded pin such that tightening said threaded pin into said circular threaded insert clamps said upper clamp and said lower clamp of said female dovetail onto said male dovetail.

11. The arrow rest of claim 8 wherein said means for securing said screw follower in said threaded bore includes a set screw threaded into said threaded bore after said screw follower is inserted to force said screw follower into threaded engagement with said micro adjust screw through said window in said shaft such that rotation of said micro adjust screw moves said screw follower and thereby said launcher body laterally along said shaft.

12. The arrow rest of claim 8 wherein said means fixed to said launcher body for supporting an arrow includes at least one launcher finger fixed to said launcher body.

13. The arrow rest of claim 8 wherein said means for biasing said shaft and said launcher body within said carriage includes:

said shaft having a first end and a second end;

said U-shaped carriage having a first wall and a second wall;

said first end of said shaft extending through said first wall of said U-shaped carriage;

a collar fixed to said first end of said shaft adjacent said U-shaped carriage;

said shaft channel having an enlarged segment in said first wall of said U-shaped carriage;

a torsion spring having a first end and a second end secured in said enlarged segment wherein one end of said torsion spring is secured in said first wall of said U-shaped carriage and said second end secured to said collar;

said torsion spring thereby providing bias to said shaft and said launcher body.

* * * * *